US010738975B2

(12) United States Patent
Chen

(10) Patent No.: US 10,738,975 B2
(45) Date of Patent: Aug. 11, 2020

(54) THIN WATERPROOF WORK LIGHT

(71) Applicant: Jiashan Qianxinhe Electronics Technology Co., Ltd., Jiashan (CN)

(72) Inventor: Bo Chen, Jiashan (CN)

(73) Assignee: Jiashan Qianxinhe Electronics Technology Co., Ltd., Jianshan (CN)

( * ) Notice: Subject to any disclaimer, the term of this patent is extended or adjusted under 35 U.S.C. 154(b) by 0 days.

(21) Appl. No.: 16/401,732

(22) Filed: May 2, 2019

(65) Prior Publication Data

US 2020/0200367 A1 Jun. 25, 2020

(51) Int. Cl.

| | |
|---|---|
| ***F21V 29/00*** | (2015.01) |
| ***F21V 15/01*** | (2006.01) |
| ***F21V 31/00*** | (2006.01) |
| ***F21V 17/16*** | (2006.01) |

(52) U.S. Cl.

CPC ..... *F21V 15/01* (2013.01); *F21V 17/16* (2013.01); *F21V 31/005* (2013.01)

(58) Field of Classification Search

CPC ..... F21V 31/005; F21W 2111/10

See application file for complete search history.

(56) References Cited

U.S. PATENT DOCUMENTS

| | | | | |
|---|---|---|---|---|
| 8,657,463 | B2 * | 2/2014 | Lichten | F21S 8/063 362/231 |
| 9,890,945 | B2 * | 2/2018 | Lazalier | F21V 7/0066 |
| 2017/0051911 | A1 * | 2/2017 | Xie | F21V 3/02 |
| 2018/0066815 | A1 * | 3/2018 | Chen | F21V 5/007 |
| 2019/0128501 | A1 * | 5/2019 | Chen | F21V 17/12 |
| 2019/0339003 | A1 * | 11/2019 | Signorino | F25D 27/00 |

* cited by examiner

*Primary Examiner* — Matthew J. Peerce

(74) *Attorney, Agent, or Firm* — Wang Law Firm, Inc.

(57) ABSTRACT

A thin waterproof work light includes a bottom cover, a top cover, and two side bezels. The bottom cover includes two side walls, two end covers, a plurality of first locks, a first storage slot, and a sealing strip. Each of the first locks include a first body extending from the side wall along the longitudinal direction of the strip bottom cover, and a first clip extending from the first body. The top cover includes a second storage slot and a plurality of second locks. The sealing strip is clamped between the first and second storage slots. Each of the second locks includes a second body, and a second clip. Each of the side bezels includes a plurality of third locks. Each of the third locks includes a third body, and a third clip. The resulting joint created by assembling the covers with the sealing strip is rendered waterproof.

13 Claims, 6 Drawing Sheets

THIN WATERPROOF WORK LIGHT

RELATED APPLICATION

This present application claims the benefit of the Chinese Application, CN201811588182.3, filed on Dec. 25, 2018, the entire specification of which is hereby incorporated by reference.

BACKGROUND

1. Technical Field

The present invention relates to a lighting device, and more particularly to a thin waterproof work light.

2. Description of the Related Art

In ordinary daily life, a general waterproof and dustproof light includes a lamp holder, lamp head, lamp cup, drive power, printed circuit board, light source, light transmitting component, cover, and more. A cover is fixed onto the lamp cup or lamp head by a screw, and the light transmitting component and the cover are pasted onto an inner side wall or step of the light cup. The connection between the cover and the lamp head can be loose. As a result, a short circuit may be caused by the entry of water vapor or moisture during waterproof testing, or unsightliness may be caused by entry of dust during dustproof testing. Therefore, the lamps cannot pass UL certification.

Moreover, a panel may be connected to the lamp cup by thread and the printed circuit board is fixed in the lamp cup by a screw and the cover is fixed onto the step of the lamp cup in some lamps. However, when a screw is used for connection and fixing instead of an elastic gasket, the connections among the lamp cup, the cover or the panel are not tight enough and water leakage easily occurs. Moreover, the necessary waterproof pad is also lacking in cover, further increasing the possibility of the lamp being short-circuited by moisture.

Therefore, it is necessary to provide a thin waterproof work light which solves the above problems.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout two views.

DETAILED DESCRIPTION

Figure 1:
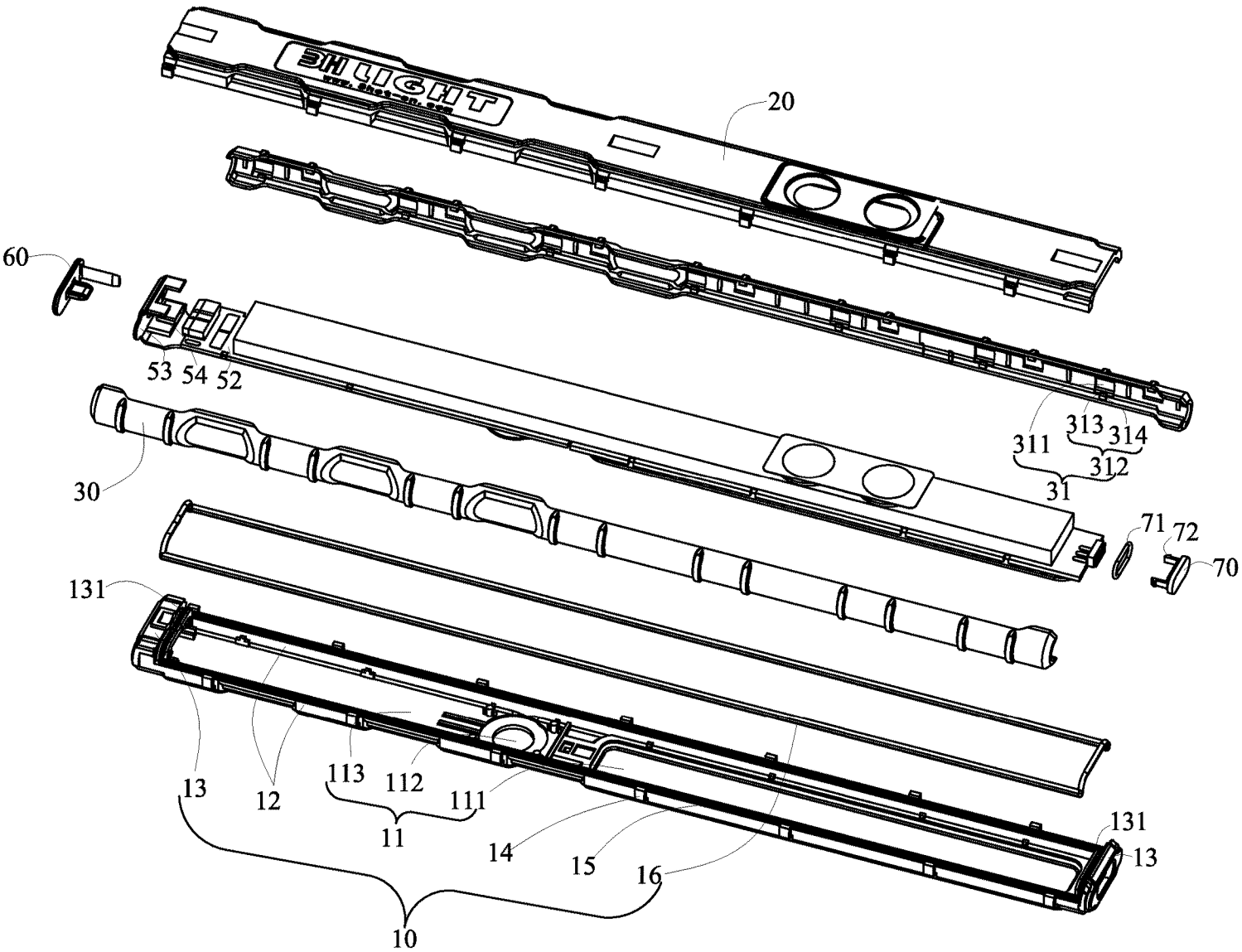
FIG. 1 is an exploded view of a thin waterproof work light according to an embodiment.
Figure 2:
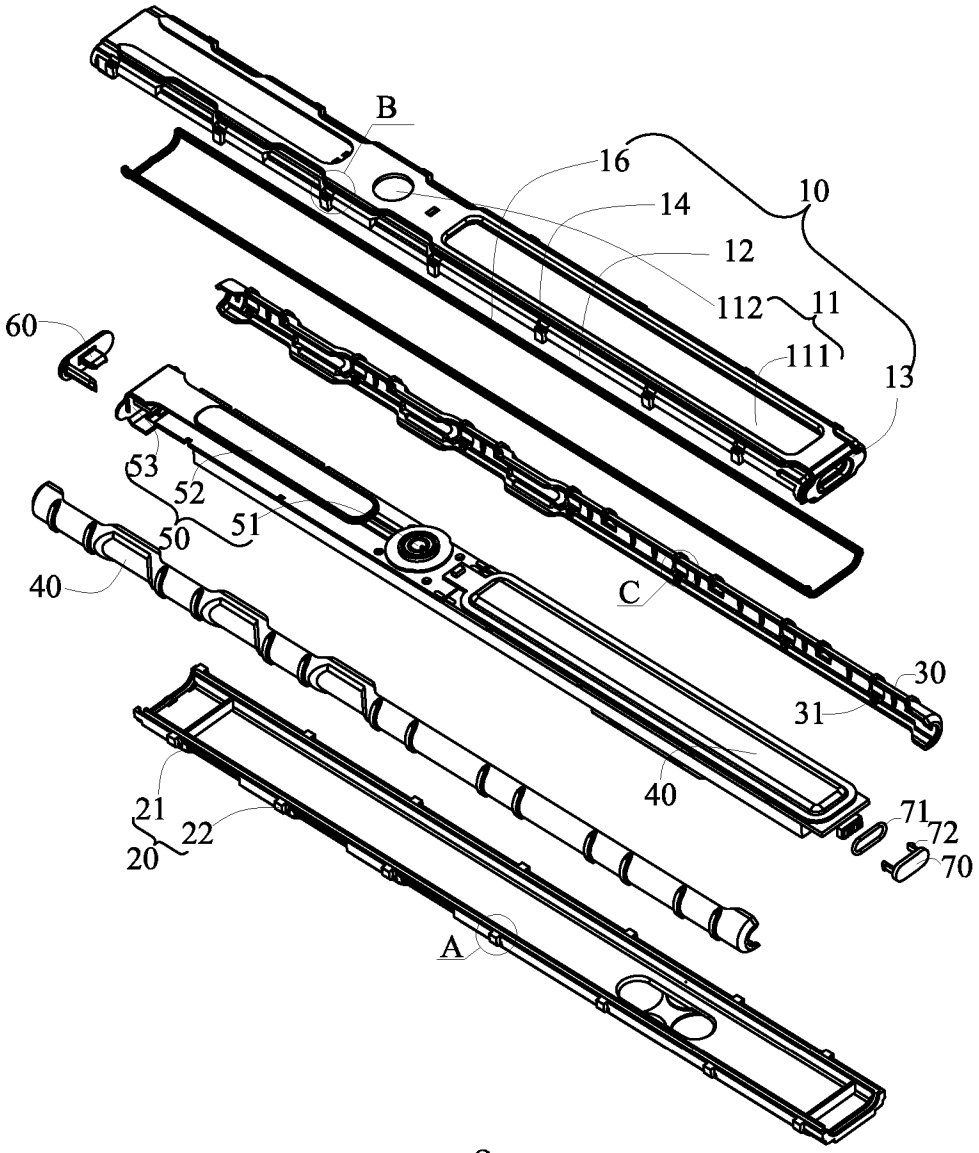
FIG. 2 is another exploded view of the thin waterproof work light of FIG. 1.
Figure 3:
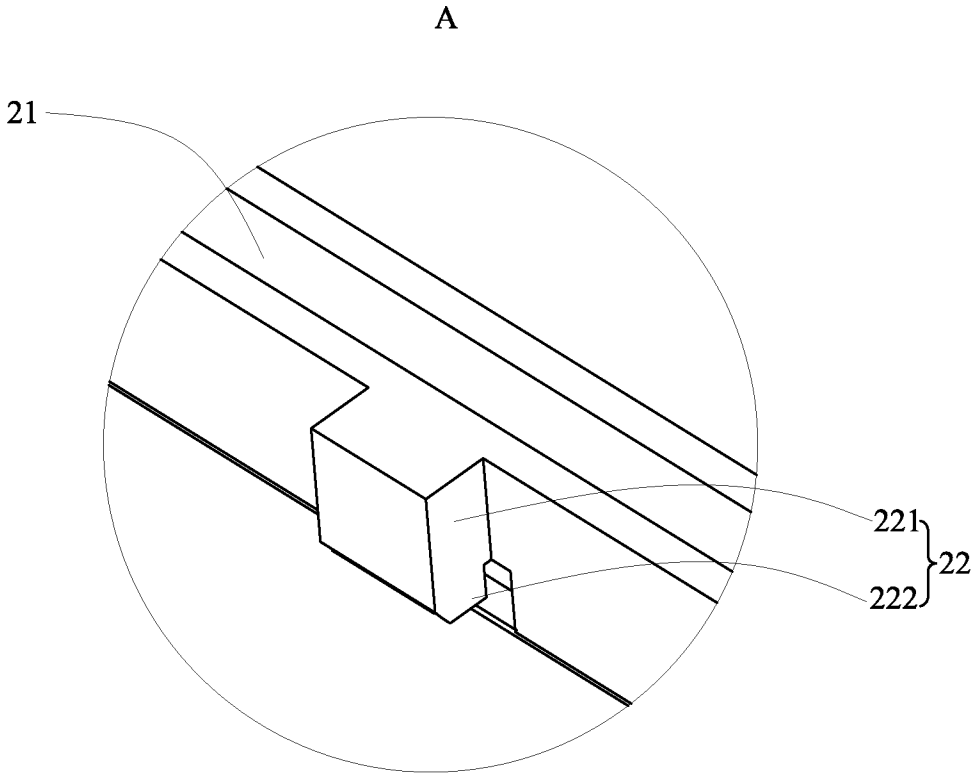
FIG. 3 is a partially enlarged schematic view of the thin waterproof work light of FIG. 2 in inset A.

The present application is illustrated by way of example and not by way of limitaion in the figures of the accompanying drawings. It should be noted that references to "an" or "one" embodiment in this application are not necessarily to the same embodiment, and such references mean at least one.

Referring to FIG. 1 to FIG. 6, a thin waterproof work light is shown in accordance with an exemplary embodiment of the present invention. The thin waterproof work light includes a strip bottom cover 10, a strip top cover 20 covering the strip bottom cover 10, two side bezels 30 fastened onto the strip bottom cover 10 and the strip top cover 20 along the longitudinal direction thereof, a light transmission plate 40 arranged on the strip bottom cover 10, and a button module 50 disposed on the strip bottom cover 10 adjacent to the light transmission plate 40. The thin waterproof work light may include other functional modules, such as a light source module arranged between the strip bottom cover 10 and the strip top cover 20, power unit, switch unit, electrical connection assembly, and so on, which are well known by a person skilled in the art and not described in detail.

Figure 4:
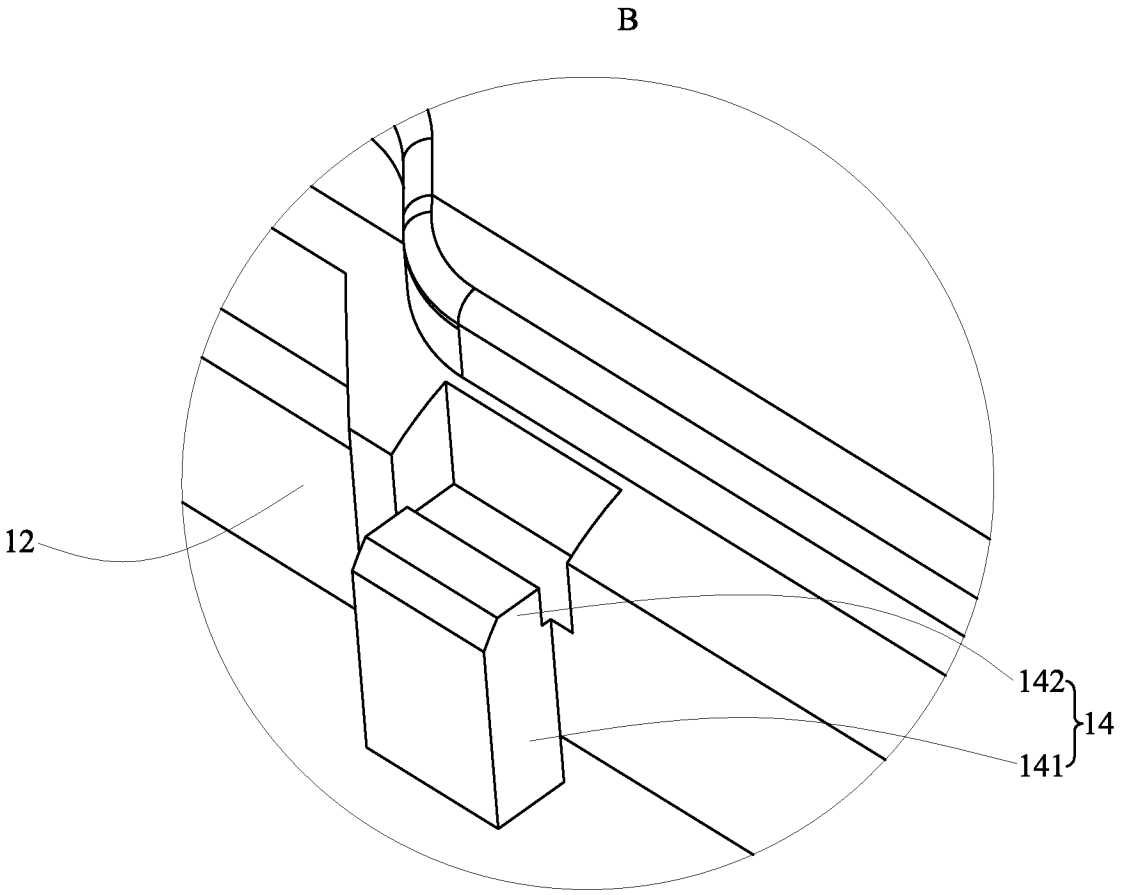
FIG. 4 is a partially enlarged schematic view of the thin waterproof work light of FIG. 2 in inset B.
Figure 5:
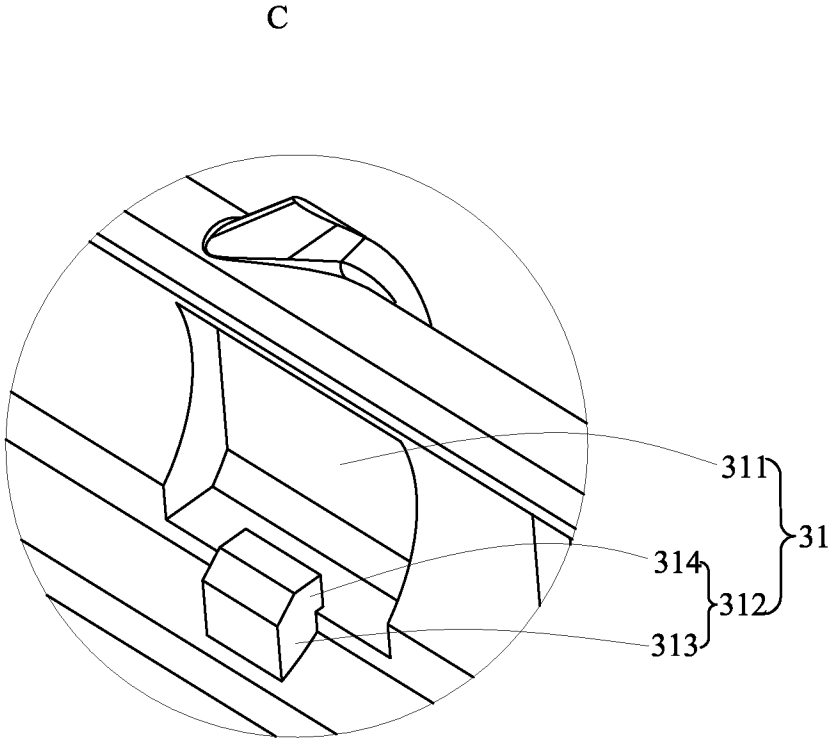
FIG. 5 is a partially enlarged schematic view of the thin waterproof work light of FIG. 2 in inset C.
Figure 6:
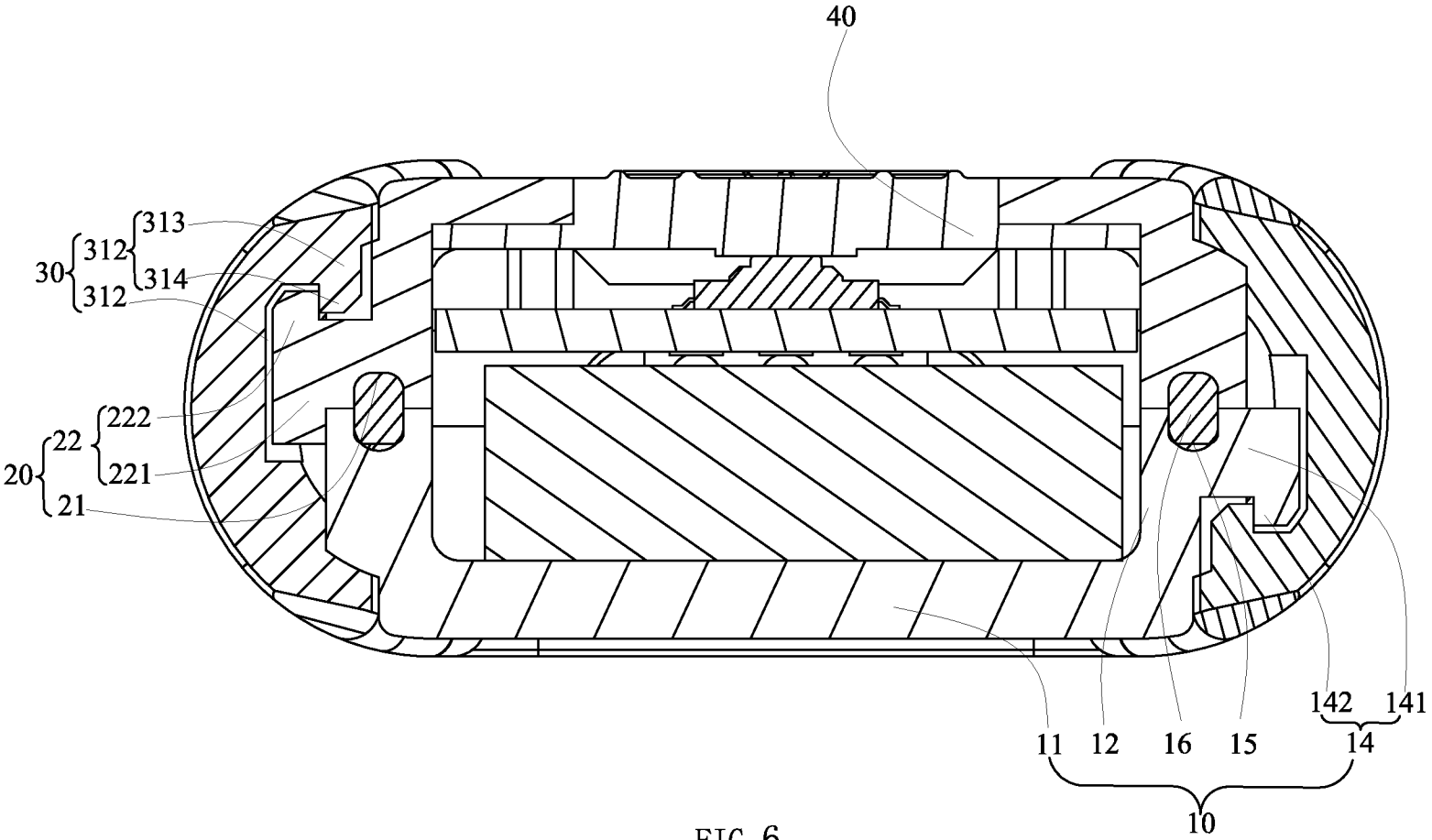
FIG. 6 is a sectional schematic view of the thin waterproof work light of FIG. 1.

The strip bottom cover 10 may have a grooved structure and includes a bottom wall 11, two side walls 12 arranged on two sides of the bottom wall 11, two end covers 13 arranged along a longitudinal direction of the strip bottom cover 10, a plurality of first locks 14 respectively disposed on the two side walls 12 and spaced apart from each other, a first storage slot 15 embedded in the two side walls 12 and capped by the two end covers 13 and arranged opposite the strip cover 20, and a sealing strip 16 contained in the first storage slot 15. The bottom wall 11, side walls 12, the end walls 13, the first lock 14, and the first storage slot 15 are integrally formed and injection molded from plastic. The grooved structure formed by the bottom wall 11, the side walls 12, and the end covers 13 is well known by a person skilled in the art and not described in detail. The bottom wall 11 includes a light transmission hole 111 configured for disposing the light plate 40, a circular hole 112 separate from the light transmission hole 111, and a holding channel 113 separate from the circular hole 112. The structure, the sealing principle, and the structural relationship of the light transmission hole 111, the circular hole 112, and the holding channel 113 will be described in detail later with the light-transmitting plate 40 and the button module 50. The light transmission hole 111, the circular hole 112, and the holding channel 113 are arranged along the longitudinal direction of the strip bottom cover 10. The end cover 13 may be a step structure and includes a step portion 131. The step portion 131 is configured for opening part of the first storage slot 15. It is understood that each of the end covers 13 has a functional hole opened thereon, such as power hole, or data interface hole, and so on. In the present embodiment, one of the end covers 13 has a power hole opened therein and another has a data interface hole opened therein. The first locks 14 are disposed on outer sides of the two side walls 12 respectively and have the same structure. Therefore, only one of the first locks 14 is described in detail as an example. Referring to FIG. 4, the first lock 14 includes a first body 141 extended outwardly from the side wall 12 of the strip bottom cover 10, and a first clip 142 extended from the first body 141 and away from the strip top cover 20 so that the first clip 142 is spaced apart from the side wall 12 of the strip bottom cover 10. The plurality of the first locks 14 are arranged along the longitudinal direction in interval. The operating principle of the first locks 14 will be described in detail later with the strip top cover 20 and the side bezels 30. In order to match with the following second locks 22, in a cross section perpendicular to the longitudinal direction of the strip bottom cover 10, only one first lock 14 intersects the cross section. That is to say, the first locks 14 disposed on the two side walls 12 are staggered along the longitudinal direction of the strip bottom cover 10. The first storage slot 15 is a ring slot and has a cross-section shape of an arc, square, or U. In the present embodiment, the first storage slot 15 has a cross-section shape of U. When the first storage slot 15 has an arc-shaped cross-section, the central angle of the arc is less than or equal to 180 degrees. The sealing strip 16 is made of silicone and may have the same cross-section shape as that of the first storage slot 15. As a result, the sealing strip 16 has a shape of U and fits tightly in the first storage slot 15.

The strip top cover 20 may also be a grooved structure and is configured for matching with the side walls 12 and the end covers 13. The strip top cover 20 includes a second storage slot 21, and a plurality of second locks 22 spaced apart from each other. The strip top cover 20 is a through groove along the longitudinal direction thereof and an end of the strip top cover 20 is directly covered onto the step portion 131. As a result, the cross-section shape of the strip top cover 20 should have the same shape as that of the step portion 131 so as to interface with the step portion 131. The second storage slot 21 has the same structure and cross-section shape as that of the first storage slot 15 and has the cross-section shape of U and interfaces with the sealing strip 16. When the strip top cover 20 covers the strip bottom cover 10, the second storage slot 21 will contain part of the sealing strip 16 which is exposed out of the first storage slot 15. Moreover, as the sealing strip 16 is tightly fit in the first and second storage slots 15 and 22, and when the strip bottom cover 10 and the strip top cover 20 are tightly clamped by the two side bezels 30, the sealing strip 16 will be deformed. This achieves the stated objective of preventing water from entering between the joint seam formed by the strip top cover 20 and the strip bottom cover 10. Each of the second locks 22 has almost the same structure and working principle as the first locks 14 and include a second body 221 and a second clip 222 extending from the first lock 221. The second clip 222 is spaced apart from the side wall of the strip top cover 20. One difference between the first clip 142 and the second clip 222 is that the second clip 222 extends away from the strip bottom cover 10. As a result, the extending direction of the second clip 222 is opposite to that of the first clip 142. In a cross section perpendicular to the longitudinal direction of the strip bottom cover 10, only one second lock 22 intersects with the cross section. That is to say, the second locks 22 are staggered along the lengthwise direction of the strip bottom cover 10. The operation of the first and second locks 14, 22 in this manner will be described in detail below in conjunction with the third lock 312 described below.

The two side bezels 30 have the same structure and shape. Therefore, only one side bezel 30 is described in detail as an example. A cross-section shape of the side bezel 30 may be an arc or a square which should match with the strip bottom cover 10 and the strip top cover 20. In the present embodiment, the side bezel 30 has a cross-section shape of an arc. The side bezel 30 has a plurality of locking connection parts 31. The plurality of the locking connection parts 31 are arranged along the longitudinal direction of the strip bottom cover 10 and respectively correspond to each of the first and second locks 14, 22 so as to respectively engage with the first and second locks 14, 22 to lock and fix the relative position between the strip bottom cover 10 and the strip top cover 20. In the present embodiment, only one locking connection part 31 is described in detail to explain the structure and working principle thereof. The locking connection part 31 includes a concavity 311, and a third lock 312 disposed on the side wall of the concavity 311. Since the locking connection part 31 is configured for matching with the first and second locks 14, 22 to engage therewith, the third lock 312 includes a third body 313, and a third clip 314 extends from the third body 313. The position of the third body 313 is related to that of the first and second locks 14, 22, that is, the positions of the first and second latches 14, 22 corresponds to that of the third body 313. The extending direction of the third clip 314 is also related respectively to that of the first and second clips 142, 222 of the corresponding first and second locks 14, 22. That is to say, the extending direction of one of the third clips 314 is opposite to that of one of the first and second clips 142, 222. When the side bezel 30 is locked onto the strip bottom cover 10 and the strip top cover 20, the third clips 314 are respectively inserted into the gap between the first clip 142 and the strip bottom cover 10 or the second clip 222 and the strip top cover 20. Moreover, as the extending direction of the first clip 142 is opposite to that of the second clip 222, the strip bottom cover 10 and the strip top cover 20 can be tightly locked together. The largest distance between the first clip 142 and the second clip 222 should be equal to or less than that of the two third clips 314 which are adjacent to each other and have opposite extension directions along the longitudinal directions of the strip bottom cover 10 and the strip top cover 20 so as to tightly lock the strip top cover 20 onto the strip bottom cover 10 and deform the sealing strip 16. Furthermore, for a cross section passing through any one of the first locks 14 and perpendicular to the longitudinal direction of the strip bottom cover 10, the cross section will pass through the second lock 22 so as that the direction of the force between the first lock 14 and the second lock 22 is parallel to the longitudinal direction of the strip bottom cover 10 and the strip top cover 20. As a result, when the sealing strip 16 is pressed, the strip bottom cover 10 or the strip top cover 20 are prevented from being separated against the intended direction of assembly, which prevents a waterproofing failure. Moreover, as described above, in a cross section perpendicular to the longitudinal direction of the strip bottom cover 10, only one of the first and second 14, 22 intersects with the cross section. As a result, when the third locks 312 are engaged with the first lock 14 or the second lock 22, the third lock 312 provides locking force on both sides of the strip bottom cover 10 or the strip top cover 20 so as to avoid excessive accumulation of mechanical fatigue due to having too many components, which may cause waterproofing failure.

When the strip bottom cover 10 and the strip top cover 20 are tightly locked together, the sealing strip 16 is also pressured tightly between the first and second storage slot 15, 21. As a result, the purpose of sealing the joint of the strip bottom cover 10 and the strip top cover 20 is achieved. Moreover, the height of the side bezel 30 is larger than that of the strip bottom cover 10 and the strip top cover 20 along the longitudinal direction thereof so as that when the thin waterproof work light is accidentally dropped, the side bezel 30 strikes the ground first, and since the side bezel 30 is made of a soft material such as silicone, the side bezel 30 can serve a cushioning function, thereby improving anti-shock and anti-drop performance of the thin waterproof work light.

The light transmission plate 40 covers the light transmission hole 111 of the strip bottom cover 10. The light transmission hole 111 may include a step in a section which is perpendicular to the longitudinal direction of the strip bottom cover 10. The light transmission plate 40 is arranged onto the step of the light transmission hole 111, specifically, the light transmission plate 40 adheres to the light-transmitting hole 111 by a waterproof glue to achieve waterproofing.

The button module 50 may be made of soft material such as silicone or rubber. The button module 50 includes a pressing portion 51, a connecting portion 52 connected to the pressing portion 51, and a flexible end portion 53 connected to the connecting portion 52. The pressing portion 51 is inserted into the circular hole 112 of the strip bottom cover 10. Specifically, the edge of the pressing portion 51 adheres to the circular hole 112 by a waterproof glue to achieve waterproofing. The connecting portion 52 is contained in the holding channel 113 so as to conserve space and fix the button module 50 in place. The flexible end portion 53 covers the step portion 131 of the end cover 13. The flexible end portion 53 has a through hole 54 opened thereon and the through hole 54 is configured for providing a passage for inserting the source plug or another function plug. Specifically, the thin waterproof work light further includes a waterproof stopper 60. The waterproof stopper 60 has the same cross-section shape as the through hole 54. However, the cross-sectional area of the waterproof stopper 60 may be slightly smaller than the cross-sectional area of the through hole 54. The waterproof plug 60 is inserted into the function hole of the end cover 13 when the function hole on the end cover 13 is not necessary for waterproofing or dustproofing the work light.

For another function hole of the end cover 13, the thin waterproof work light further includes a sealing stopper 70 and a sealing ring 71 wrapped onto the sealing stopper 70. The sealing stopper 70 has two barbs 72 set thereon and the sealing ring 72 wraps onto the two barbs 72. When the two barbs 72 are inserted into the function hole of the end cover 13 and hooked on the end cover 13, the sealing ring 71 is clamped between the sealing stopper 70 and the end cover 13 so as to waterproof and dustproof the work light.

As described above, the thin waterproof work light has the special waterproof structure of the strip bottom cover 10 and the strip top cover 20, specifically, the first storage slot 15 is opened on the strip bottom cover 10, the second storage slot 21 is opened on the strip top cover 20 and the sealing strip 16 is tightly clamped between the first and second storage slots 15, 21 and is deformed. Therefore, when the strip bottom cover 10 and the strip top cover 20 are tightly locked, the resulting joint formed by the strip bottom cover 10 and the strip top cover 20 is made waterproof. Moreover, in order to tightly press the strip bottom cover 10 onto the strip top cover 20 without increasing the length of the strip bottom cover 10 and the strip top cover 20 in the assembly direction thereof, the first and second locks 14, 22 are respectively arranged on the side wall of the strip bottom cover 10 and the strip top cover 20 and the first and second clips 142, 222 have opposite directions of protrusion. And, the first and second locks 14, 22 are tightly locked together using the third lock 312. Since the first, second and third locks 14, 22, 312 are disposed on the side walls of the thin waterproof work light, the thickness of the thin waterproof light will not increase. As a result, the strip bottom cover 10 and the strip top cover 20 can be tightly locked together to form a waterproof and dustproof device without increasing the thickness of the work light, thereby making the thin waterproof work light as thin as possible.

While the disclosure has been described by way of example and in terms of exemplary embodiment, it is to be understood that the disclosure is not limited thereto. On the contrary, it is intended to encompass various modifications and similar arrangements (as would be apparent to those skilled in the art). Therefore, the scope of the appended claims should be accorded the broadest interpretation so as to encompass all such modifications and similar arrangements.

What is claimed is:

1. A thin waterproof work light, comprising:

a strip bottom cover, the strip bottom cover comprising two side walls spaced apart from each other, two end covers arranged respectively on two ends of the two side walls along a longitudinal direction thereof, a plurality of first locks disposed at regular intervals on each of the two side walls and spaced apart from each other, a first storage slot embedded in each of the two side walls and capped by the two end covers, and a sealing strip contained in the first storage slot;

a strip top cover covering the strip bottom cover, the strip top cover comprising a second storage slot corresponding to the first storage slot, and a plurality of second locks spaced apart from each other at regular intervals on the strip top cover; and two side bezels configured for locking the strip bottom cover and the strip top cover, each of the side bezels comprising a plurality of third locks arranged along the longitudinal direction of the strip bottom cover;

wherein each of the first locks comprises a first body protruding from one of the two side walls and each first lock has a first clip protruding from the first body, each first clip extending away from the strip top cover;

each of the second locks comprises a second body and each second lock has a second clip protruding from the second body, each second clip extending away from the strip bottom cover;

each of the third locks corresponds to an opposite first lock or second lock and comprises a third body and each third lock has a third clip protruding from the third body, each third clip protruding in a direction opposite the extending directions of the corresponding first clip or the corresponding second clip;

the sealing strip is a ring;

the first storage slot being uncovered in the direction of the strip top cover, and the sealing strip is clamped between the first storage slot and the second storage slot.

2. The thin waterproof work light as claimed in claim 1, wherein the first clip does not touch the side wall of the strip bottom cover, and the third clip is inserted between the first clip and the side wall.

3. The thin waterproof work light as claimed in claim 1, wherein the second clip does not touch the strip top cover, and the third clip is inserted between the second clip and the strip top cover.

4. The thin waterproof work light as claimed in claim 1, wherein cross-sectional shapes of the first and second storage slots are arcs, center angles of the arcs being less than or equal to 180 degrees.

5. The thin waterproof work light as claimed in claim 1, wherein in a cross section perpendicular to the longitudinal direction of the strip bottom cover, only one first lock intersects the cross section.

6. The thin waterproof work light as claimed in claim 1, wherein in a cross section perpendicular to the longitudinal direction of the strip bottom cover, only one second lock intersects the cross section.

7. The thin waterproof work light as claimed in claim 1, wherein in a cross section perpendicular to the longitudinal direction of the strip bottom cover and intersecting one of the first locks, the cross section also intersects with one of the second locks.

8. The thin waterproof work light as claimed in claim 1, wherein each side bezel comprises a plurality of locking connection parts, each of the locking connection parts comprises a concavity, the third lock is disposed on one side of the concavity.

9. The thin waterproof work light as claimed in claim 1, wherein each of the end covers contains a step portion into which the first storage slot extends, and in a cross section perpendicular to the longitudinal direction of the strip bottom cover, a cross-sectional shape of the step portion is identical to that of the strip top cover.

10. The thin waterproof work light as claimed in claim 1, wherein a largest distance between the first clip and the second clip is equal to or less than a distance between two sequential third clips which are adjacent to each other.

11. The thin waterproof work light as claimed in claim 1, wherein the strip bottom cover further comprises a bottom wall disposed between the two side walls, a light transmission opening in the bottom wall, a holding channel in the bottom wall, and a circular hole in the bottom wall between, wherein the circular hole is located between the light transmission opening and the holding channel, and the light transmission opening, the holding channel, and the circular hole are separate from each other.

12. The thin waterproof work light as claimed in claim 11, further comprising a light transmission plate attached to the light transmission opening in the bottom wall of the strip bottom cover by a waterproof glue.

13. The thin waterproof work light as claimed in claim 11, further comprising a button assembly attached to the strip bottom cover, wherein the button assembly comprises:

a pressing portion having a circular rim, a connecting portion connected to the pressing portion, and a flexible end portion connected to the connecting portion, the flexible end portion having a through hole for connecting a functional plug to the pressing portion, wherein the circular rim of the pressing portion is connected to the circular hole of the bottom wall, the connecting portion is disposed in the holding channel of the bottom wall to fix the button assembly in place, and the flexible end portion covering one of the end covers.

* * * * *